United States Patent [19]

Harrison

[11] 4,033,834

[45] July 5, 1977

[54] METHOD FOR PLATING

[75] Inventor: Norman Harrison, Sabden, England

[73] Assignee: Lucas Electrical Company Limited, Birmingham, England

[22] Filed: July 28, 1976

[21] Appl. No.: 709,520

Related U.S. Application Data

[62] Division of Ser. No. 621,141, Oct. 9, 1975.

[30] Foreign Application Priority Data

Oct. 16, 1975 United Kingdom ..... 44790/75

[52] U.S. Cl. ..... 204/15; 204/25

[51] Int. Cl.[2] ..... C25D 5/02; C25D 7/04

[58] Field of Search ..... 204/297 R, 297 W, 297 M, 204/25, 15

[56] References Cited

UNITED STATES PATENTS 3,257,308 6/1966 Cottom ..... 204/297 W 3,393,597 7/1968 Hoaglund ..... 204/15

FOREIGN PATENTS OR APPLICATIONS 1,007,128 4/1957 Germany ..... 204/25

*Primary Examiner*—T. M. Tufariello

[57] ABSTRACT

A method for plating using a plating jig comprising a metal frame with an impervious covering of an electrically insulating material on the frame. At least one part of the frame is bare of the covering to permit contact being made with a component to be held by the jig for plating. A contact piece encloses said bare part and is formed of a non-conductive resiliently compressible matrix containing conductive particles such that a conductive path is established through the matrix wherever this is compressed. The contact piece is arranged to be compressed by contact with a component on the jig so as to establish an electrical connection between the frame and the component.

1 Claim, 2 Drawing Figures

METHOD FOR PLATING

This is a divisional of application Ser. No. 621,141 filed Oct. 9, 1975.

This invention relates to a method of plating metal components.

Conventional methods use a plating jig which includes a metal frame provided with an impervious covering of electrically insulating material. Where electrical contact between the jig and the component to be supported is required the metal frame is left bare. The whole of the bared area is not, however, engaged by the component so that the bared area becomes plated in time and jigs must therefore be taken out of service periodically for cleaning. Such cleaning is an expensive process which can make a significant contribution to the total cost of operating a plating plant.

It is accordingly an object of the invention to provide a method of plating in which the need for periodic cleaning is avoided.

The method of plating in accordance with the invention comprises making an electrical connection between a metal frame having an impervious covering of an electrically insulating material on the frame, and a component to be plated at least one part of the frame being bare of such covering to permit contact being made with the component to be held by the jig for plating through a contact piece enclosing said bare part and being formed of a non-conductive resiliently compressible matrix containing conductive particles such that a conductive path is established through the matrix wherever this is compressed, the contact piece being arranged to be compressed by contact with a component on the jig so as to establish an electrically conductive path between the frame and the component.

The surface of the contact piece is not electrically connected to the frame except where it is compressed by contact with the component.

A particular advantage can be obtained when a component having a tapped or other close tolerance bore is to be plated externally. In this case the contact piece can be in the form of a bush onto which the bore is a push fit. The contact piece then not only provides the required electrical connection to the component but also seals the bore, thereby obviating the need for remachining of the bore after plating.

Figure 1:
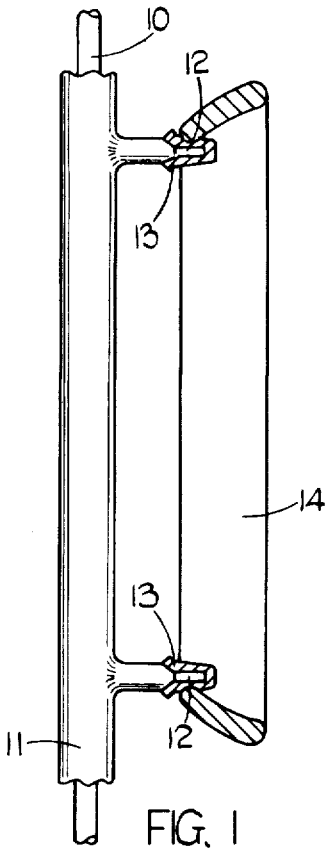
Figure 2:
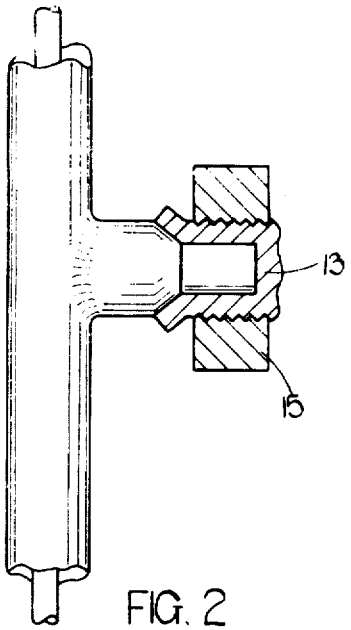

In the accompanying drawings FIGS. 1 and 2 are fragmentary part sectional views showing apparatus which could be used in the present examples of the invention.

FIG. 1 shows a simple jig for supporting an annular component. The jig includes a metal frame 10 to which an electrical connection is made in use. The frame 10 has a covering 11 of an electrolyte resistant synthetic resin material. The frame has support fingers 12 the ends of which are bare to enable an electrical connection to be made between the frame and a component to be supported on the jig. The end of each finger 12 is, however, provided with a contact piece 13 which encloses the bare end and is formed of a known material which consists of a matrix of a resiliently compressible non-conductive material such as a synthetic elastomer, in which there is distributed a plurality of conductive metal particles. When the material is undeformed the particles do not engage one another but when it is compressed between two conductive elements an electrically conductive path is established between the two elements as a result of contact between the particles.

The component 14 causes such compression of the contact piece 13 so that an electrical connection is provided between the frame 10 and the components. However, since the pieces 13 are only compressed when actually engaged with the components, the exposed surface of each piece 13 is not in electrical contact with the frame 10. It does not, therefore, become plated.

In the example shown in FIG. 2 it is required to support a nut 15 for plating. In this case the external diameter of the contact piece 13 is made sufficiently large to ensure that it is compressed by contact with the thread in the bore of the nut. The bore is thus sealed by the piece 13 and the interior of the bore is not plated.

It is to be appreciated that in the method as above described normally, the jigs would support a plurality of components rather than a single component as shown. The bared parts of the frame may take many different forms and may, in fact, form parts of mechanically operated clamps.

A convenient material for forming the contact pieces has the composition:-

| | |
|---|---|
| Elastomer (RTV 630 A | 27.0% by weight |
| (RTV 630 B | 2.7% " " |
| Silver plated copper particles having a mesh size 100–150 | 70.3% " " |

RTV indicates "room temperature vulcansing" and the elastomer constituents are available from:

Silicone Products Division
Engineering Polymers Ltd.
Moss Industrial Estate
St Helens Road
LEIGH
LANCS.

The contact pieces are moulded in the above material and are cured for 15 mins. in a closed mould at 150° C.

I claim:

1. A method of externally plating a hollow component, including making an electrical connection between the component and a plating jig by inserting into the bore of the component, as a push fit, a contact piece of the jig, the contact piece closing the bore to prevent ingress of electrolyte in use and being formed from a non-conducting resiliently compressible matrix containing conductive particles such that a conductive path is established through the matrix wherever this is compressed, the contact piece being arranged to be compressed by contact with the interior of the component and so establish an electrical connection between the conductive frame of the jig and the component.

* * * * *